US005247742A

United States Patent [19]

Kilgore et al.

[11] Patent Number: 5,247,742

[45] Date of Patent: Sep. 28, 1993

[54] ATHLETIC SHOE WITH PRONATION REARFOOT MOTION CONTROL DEVICE

[75] Inventors: Bruce J. Kilgore, Lake Oswego; Martyn R. Shorten, Portland, both of Oreg.

[73] Assignee: Nike, Inc., Beaverton, Oreg.

[21] Appl. No.: 625,469

[22] Filed: Dec. 11, 1990

Related U.S. Application Data

[63] Continuation of Ser. No. 433,436, Nov. 8, 1989, Pat. No. 5,046,267, which is a continuation of Ser. No. 115,661, Nov. 6, 1987, abandoned.

[51] Int. Cl.[5] ..... A43B 13/12; A43B 5/00

[52] U.S. Cl. ..... 36/114; 36/30 R; 36/31; A43B/13/12; A43B/5/00

[58] Field of Search ..... 36/31, 30 R, 114, 69; 128/584, 585

[56] References Cited

U.S. PATENT DOCUMENTS

| | | | |
|---|---|---|---|
| 2,034,243 | 3/1936 | Maxwell | 36/8.5 |
| 2,156,532 | 5/1939 | Grieder | 36/2.5 |
| 2,237,190 | 4/1941 | McLeod | 36/29 |
| 2,244,504 | 6/1941 | Riddell | 36/68 |
| 2,255,100 | 9/1941 | Brady | 36/71 |
| 2,635,362 | 4/1953 | Lelyveld | 36/8.5 |
| 2,638,689 | 5/1953 | Stritter | 36/68 |
| 2,660,814 | 12/1953 | Ritchey | 36/71 |
| 2,677,906 | 5/1954 | Reed | 36/71 |
| 2,723,468 | 11/1956 | Marcy | 36/68 |
| 2,885,797 | 5/1959 | Chrencik | 36/2.5 |
| 3,120,712 | 2/1964 | Menken | 36/29 |
| 3,333,353 | 8/1967 | Garcia | 36/68 |
| 3,724,106 | 4/1973 | Magidson | 36/44 |
| 3,738,373 | 6/1973 | Glancy | 128/585 |
| 4,128,950 | 12/1978 | Bowerman et al. | 36/30 R |
| 4,183,156 | 1/1980 | Rudy | 36/44 |
| 4,255,877 | 3/1981 | Bowerman | 36/129 |
| 4,287,675 | 9/1981 | Norton et al. | 36/129 |
| 4,288,929 | 9/1981 | Norton et al. | 36/69 |
| 4,297,797 | 11/1981 | Meyers | 36/44 |
| 4,316,334 | 2/1982 | Hunt | 36/91 |
| 4,322,895 | 4/1982 | Hockerson | 36/129 |
| 4,354,318 | 10/1982 | Frederick et al. | 36/30 R |
| 4,360,027 | 11/1982 | Friedlander et al. | 128/581 |
| 4,364,188 | 12/1982 | Turner et al. | 36/31 |
| 4,364,189 | 12/1982 | Bates | 36/31 |
| 4,372,058 | 2/1983 | Stubblefield | 36/32 |
| 4,391,048 | 7/1983 | Lutz | 36/28 |
| 4,439,936 | 4/1984 | Clarke et al. | 36/102 |
| 4,445,283 | 5/1984 | Meyers | 36/29 |
| 4,449,307 | 5/1984 | Stubblefield | 36/32 |
| 4,484,397 | 11/1984 | Curley, Jr. | 36/92 |
| 4,486,964 | 12/1984 | Rudy | 36/28 |
| 4,490,928 | 1/1985 | Kawashima | 36/69 |
| 4,506,460 | 3/1985 | Rudy | 36/28 |
| 4,551,930 | 11/1985 | Graham et al. | 36/30 R |
| 4,561,195 | 12/1985 | Onoda et al. | 36/30 R |
| 4,608,768 | 9/1986 | Cavanagh | 36/28 |
| 4,614,046 | 9/1986 | Dassler | 36/30 R |
| 4,616,431 | 10/1986 | Dassler | 36/28 |
| 4,624,061 | 11/1986 | Wezel et al. | 36/30 A |
| 4,680,875 | 7/1987 | Danieli | 36/31 |
| 4,730,402 | 3/1988 | Norton et al. | 36/30 R |
| 4,731,939 | 3/1988 | Parracho et al. | 36/31 |
| 4,741,114 | 5/1988 | Stubblefield | 36/32 |
| 4,759,136 | 7/1988 | Stewart et al. | 36/114 |
| 4,854,057 | 8/1989 | Misevich et al. | 36/114 |
| 5,025,573 | 6/1991 | Gese et al. | 36/30 R |

FOREIGN PATENT DOCUMENTS 2114869 7/1980 United Kingdom .

OTHER PUBLICATIONS

Article on "Shoe Modifications in Lower-Extremity Orthotics by Zamosky and published by the Bulletin of Prosthetics Research", vol. 10, No. 2, pp. 55-95 (Fall 1964).

Brochure and Advertisement on a so-called ARC TM element; brochure dated 1988; Advertisement copied from Mar. 1989 edition of Runner's World.

*Primary Examiner*—Steven N. Meyers

*Attorney, Agent, or Firm*—Banner, Birch, McKie & Beckett

[57] ABSTRACT

A cushioning sole for use in footwear, in particular athletic shoes, is disclosed. The cushioning sole includes a pronation control device incorporated into the midsole. The device functions to gradually increase the resistance to compression of the midsole from the lateral side to a maximum along the medial side. The device includes generally vertically extending rigid members and a plurality of horizontally extending plate members.

26 Claims, 2 Drawing Sheets

ATHLETIC SHOE WITH PRONATION REARFOOT MOTION CONTROL DEVICE

This application is a continuation of application Ser. No. 07/433,436, filed Nov. 8, 1989, now U.S. Pat. No. 5,046,267, which is a continuation of application Ser. No. 115,661, filed Nov. 6, 1987, now abandoned.

TECHNICAL FIELD

The invention relates to footwear, more particularly to athletic shoes, wherein a cushioning sole is provided with a pronation control device to control the pronation motion of a wearer's foot. The sole includes a sole member which is compressible and resilient to thereby cushion foot impact, and the control device increases the resistance to compression of the sole member in the area adjacent the medial side of the sole.

BACKGROUND OF THE INVENTION

The modern shoe, particularly an athletic shoe, is a combination of many elements which have specific functions, all of which must work together for the support and protection of the foot.

Athletic shoes today are as varied in design and purpose as are the rules for the sports in which the shoes are worn. Tennis shoes, racquetball shoes, basketball shoes, running shoes, baseball shoes, football shoes, weightlifting shoes, walking shoes, etc. are all designed to be used in very specific, and very different, ways. They are also designed to provide a unique and specific combination of traction, support and protection to enhance performance. Not only are shoes designed for specific sports, they are also designed to meet the specific characteristics of the user. For example, shoes are designed differently for heavier persons than for lighter persons; differently for wide feet than for narrow feet; differently for high arches than for low arches, etc. Some shoes are designed to correct physical problems, such as over-pronation, while others include devices, such as ankle supports, to prevent physical problems from developing.

A shoe is divided into two general parts, an upper and a sole. The upper is designed to snuggly and comfortably enclose the foot, while the sole must provide traction, protection, and a durable wear surface. The considerable forces generated by running require that the sole of a running shoe provide enhanced protection and shock absorption for the foot and leg. It is also desirable to have enhanced protection and shock absorption for the foot and leg in all types of footwear. Accordingly, the sole of a running shoe typically includes several layers, including a resilient, shock absorbing or cushioning layer as a midsole and a ground contacting outer sole or outsole which provides both durability and traction. This is particularly true for training or jogging shoes designed to be used over long distances and over a long period of time. The sole also provides a broad, stable base to support the foot during ground contact.

The typical motion of the foot during running proceeds as follows. First, the heel strikes the ground, followed by the ball of the foot. As the heel leaves the ground, the foot rolls forward so that the toes make contact, and finally the entire foot leaves the ground to begin another cycle. During the time, that the foot is in contact with the ground, it typically is rolling from the outside or lateral side to the inside or medial side, a process called pronation. That is, normally, the outside of the heel strikes first and the toes on the inside of the foot leave the ground last. While the foot is air borne and preparing for another cycle the opposite process, called supination, occurs. Pronation, the inward roll of the foot in contact with the ground, although normal, can be a potential source of foot and leg injury, particularly if it is excessive. The use of soft cushioning materials in the midsole of running shoes, while providing protection against impact forces, can encourage instability of the sub-talar joint of the ankle, thereby contributing to the tendency for over-pronation. This instability has been cited as a contributor to "runners knee" and other athletic injuries.

Various methods for resisting excessive pronation or instability of the sub-talar joint have been proposed and incorporated into prior art athletic shoes as "stability" devices. In general, these devices have been fashioned by modifying conventional shoe components, such as the heel counter, and by modifying the midsole cushioning materials. For example, one technique incorporates a relatively stiff heel counter support over the heel counter, as shown in U.S. Pat. No. 4,288,929. A similar technique, wherein support is provided to a heel counter by a bead of material, is shown in U.S. Pat. No. 4,354,318. Another prior art technique to enhance motion control during foot impact is by building up the heel counter itself, such as shown in U.S. Pat. Nos. 4,255,877 and 4,287,675. Another technique is the use of higher density cushioning materials on the medial side of the shoe to resist pronation, such as shown in U.S. Pat. Nos. 4,364,188 and 4,364,189. The use of a less compressible or firmer fluid tight chamber in the medial heel area of a sole is disclosed in U.S. Pat. Nos. 4,297,797 and 4,445,283. Although these prior art techniques have exhibited a degree of success in controlling sub-talar joint motion and, hence, over-pronation, they have certain disadvantages. Generally, these techniques add to the weight and manufacturing expense of the shoes. Furthermore, the firmer, higher density foam midsole materials are subject to compression set and reduce the efficacy of the cushioning system.

The present invention was designed to take advantage of the lightweight cushioning capability of the materials used in current athletic shoes, while enhancing the stability of the shoes without incurring the above disadvantages of prior art "stability" devices.

SUMMARY OF THE INVENTION

The invention relates to a cushioning sole for use in footwear which includes a pronation control device to control the pronation motion of a wearer's foot. The sole comprises a sole member which extends along at least the heel and arch areas of the sole. The sole member is compressible and resilient to thereby cushion foot impact, and includes a mechanism incorporated into it for increasing the resistance to compression of the sole member in an area adjacent its medial side to thereby control pronation motion. The compression resistance increasing mechanism includes at least one substantially rigid member formed of a substantially non-compressible material and extending vertically through at least a portion of the vertical extent of the sole member.

The sole member preferably extends along substantially the entire foot bed and is formed at least partially of a foam material. The compression resistance increasing mechanism preferably includes at least one generally horizontally extending plate which gradually increases the resistance to compression of the sole member from the lateral side to a maximum adjacent the medial side of the sole member. The rigid member is preferably formed as at least two hollow columns spaced longitudinally from one another, and the plate extends between and laterally from adjacent the tops of the columns in a cantilever manner. The plate is preferably formed as a plurality of separate plate members which extend laterally from the medial side to an area past the centerline of the heel area.

When the foot of a typical runner initially contacts the ground along the lateral heel area, the material of the sole member compresses to cushion the foot. As the runner's foot begins to roll inward (pronate), the distal ends of the plate members add a degree of resistance to compression of the sole member. As the runner's foot further rolls inward, portions of the plate members which extend in a cantilever fashion from the medial side of the sole resist compression of the sole member to a greater degree, thereby further stabilizing the foot. Maximum resistance to compression of the sole member and, hence, maximum stabilization of the foot occurs along the medial side of the sole where the vertically extending, non-compressible rigid members are disposed.

The use of the pronation control device of the present invention enables soft cushioning materials to be used in footwear soles while retaining sub-talar joint stability. The device functions by increasing the compaction resistance of the medial side of the midsole, thereby resisting pronation, while the more compliant lateral side allows deflection of the lateral portion of the midsole during impact. This controlled deflection reduces the lever arm for the force acting around the sub-talar joint. The device thus effectively reduces calcaneal eversion at foot strike, resulting in increased resistance to pronation of the sub-talar joint and lower velocities of pronation.

The biomechanical characteristics of the pronation control device and, hence, the degree of resistance to pronation and high rates of pronation of the sub-talar joint may be varied by changing the number and height of the rigid members or columns, by changing the number, size and spacing of the separate horizontal plate members, and by changing the physical properties of the material forming the rigid member and plate members.

The use of a separate device, according to the present invention, for the control of pronation has several advantages over the prior art techniques of adjusting the densities of the cushioning materials. The stability characteristics of the shoe can be varied independently of the materials used for cushioning and is thus not dependent on the characteristics of these materials. Also, since the pronation control device is made of relatively high modulus and high hardness material, the device is not subject to compaction like foam cushioning materials, weighs less, is easier to manufacture, and may be combined with a variety of cushioning materials.

Various advantages and features of novelty which characterize the invention are pointed out with particularity in the claims annexed hereto and forming a part hereof. However, for a better understanding of the invention, its advantages, and objects obtained by its use, reference should be had to the drawings which form a further part hereof, and to the accompanying descriptive matter, in which there is illustrated and described preferred embodiments of the invention.

DETAILED DESCRIPTION OF THE INVENTION

Figure 1:
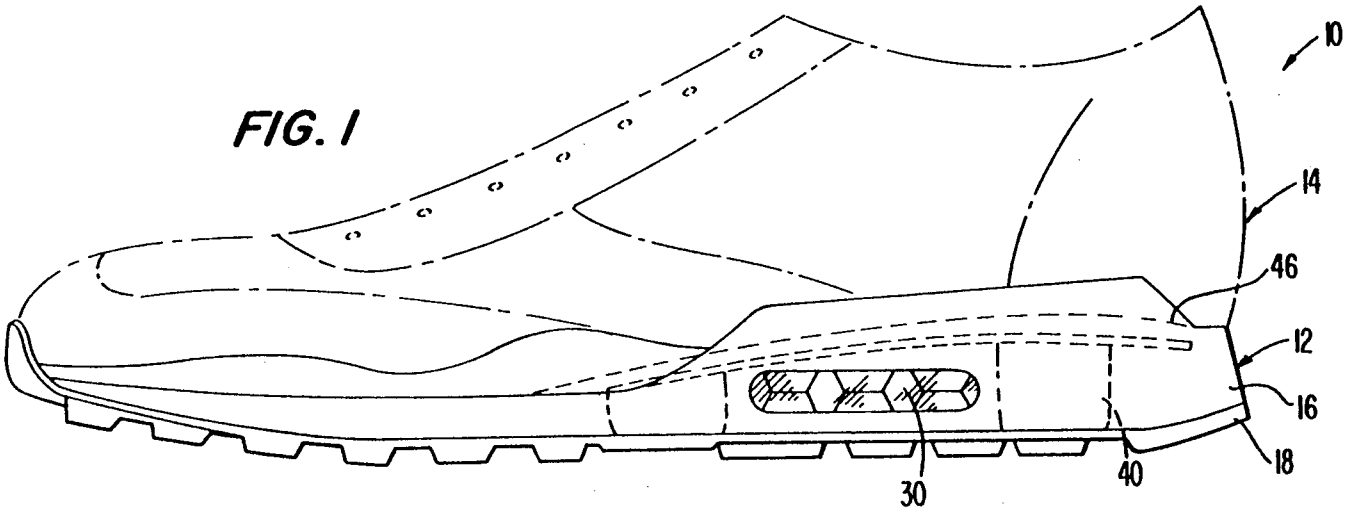
FIG. 1 is a side view of an athletic shoe embodying the invention.

Referring to the drawings, wherein like numerals indicate like elements, an article of footwear in accordance with the present invention, such as a running shoe, is generally shown as 10. Shoe 10 includes a sole structure 12 and an upper 14 attached to it. Upper 14 can be of any conventional design, while sole structure 12 incorporates novel features of the present invention. Sole structure 12 includes a cushioning or force absorbing midsole 16 and a flexible, wear resistant outsole 18. Of course, where appropriate, the midsole and outsole portions can be formed as a single integral unit.

Shoe 10 and, hence, sole 12 can be generally divided into a heel section 20 rearward of line L1, an arch section 22 between lines L1 and L2, and a forepart 24 section forward of line L2. Lines L1 and L2 are not precise lines of demarkation but rather divide sole 12 into relative sections related generally to portions of the human foot. Line L3 is a centerline of heel section 20, which divides heel section 20 and arch section 22 into a medial half 26 and a lateral half 28. The medial side wall or sole 12 is indicated as 27, while the lateral side wall is indicated as 29.

Midsole 16 is formed of a cushioning, resilient foam material, such as a polyurethane foam into which a sealed resilient insert 30 is encapsulated. The perimeter of insert 30 is shown diagrammatically in dashed line in FIG. 2. Insert 30 is preferably a gas-filled bladder formed according to the teachings of U.S. Pat. Nos. 4,183,156 and 4,219,945 of Marion F. Rudy. Such a gas filled bladder is formed from a flexible material which is sealed along its perimeter and at preselected locations within its perimeter which, after being filled to a relatively high pressure by a gas having a low diffusion rate through the flexible material, takes on a generally flat bladder configuration. The bladder is thereafter encapsulated in the foam material comprising the remainder of the midsole, as disclosed in the '945 patent. Alternatively, insert 30 can be omitted and the entire midsole 16 can be formed of a cushioning foam material. In either case midsole 16 functions as a compressible and resilient unit which cushions foot impact.

A pronation control device 40 is incorporated into midsole 16 in heel section 20 and arch section 22. Device 40 is preferably formed of a single integral piece of plastic material, such as a thermoplastic polyester elastomer. The plastic material is relatively hard and substantially non-compressible. The plastic material preferably has a relatively high flex modulus, e.g. preferably 75,000 to 125,000 psi as determined by a standard ASTM test, and a hardness preferably in the range of 65 to 72 Shore D. This is in sharp contrast to the much softer foam material used in a typical midsole, such as midsole 16, which generally has a hardness in the range of 40 to 70 on the Asker C scale. Device 40 functions to gradually increase the resistance to compression of midsole 16 proceeding from a minimum resistance at the lateral side to a maximum resistance at the medial side. Device 40 includes a pair of longitudinally spaced rigid members 42*a* and 42*b* and a plurality of separate horizontal plates 44*a*, 44*b*, 44*c*, 44*d* and 44*e*. Device 40 is incorporated into midsole 16 with rigid members 42*a* and 42*b* having outer side walls 43*a* and 43*b* disposed adjacent the medial edge of midsole 16 in heel section 20 and arch section 22, and extending generally vertically. In the illustrated embodiment, rigid members 42*a* and 42*b* extend vertically substantially from the bottom of midsole 16, to the top of midsole 16, which is illustrated by dashed line 46. If less compaction or compression resistance is desired, the vertical extent of rigid members 42*a* and 42*b* can be decreased. Alternatively, if additional resistance to compaction is desired, an additional number of rigid members can be added along the medial side of sole 12. In order to keep the weight of device 40 to a minimum, rigid members 42*a* and 42*b* are preferably formed in the shape of hollow columns having a generally rectangular cross-sectional configuration. Typically the walls of the columns have a thin cross-section or thickness, such as 0.03" to 0.04".

Figure 2:
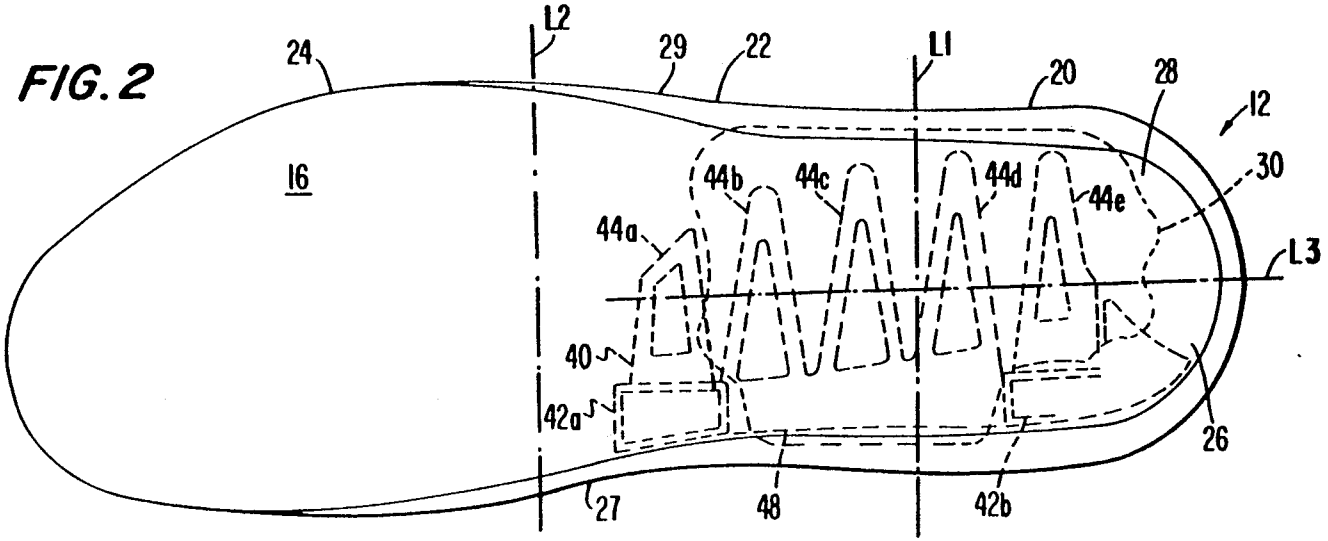
FIG. 2 is a top plan view of the sole of the athletic shoe illustrated in FIG. 1, with the pronation control device illustrated in phantom line.
Figure 3:
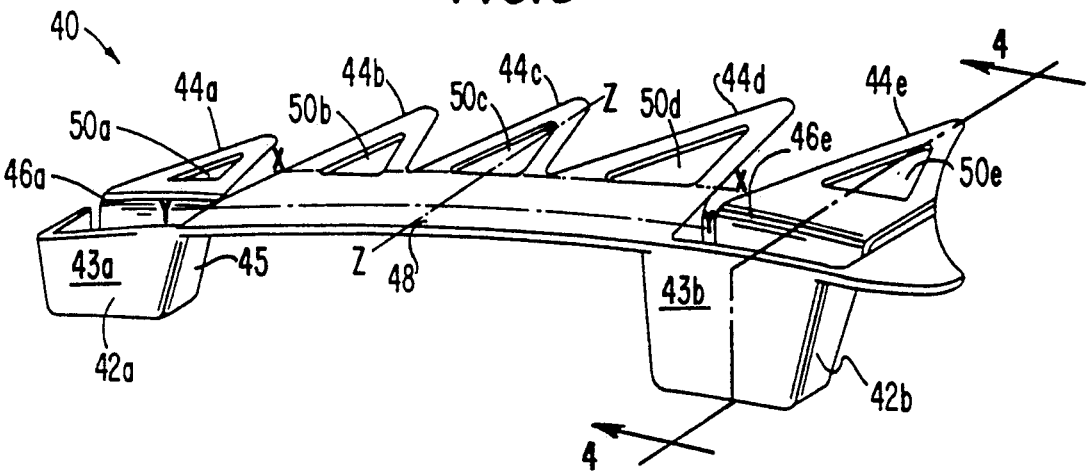
FIG. 3 is a perspective view of the pronation control device.
Figure 4:
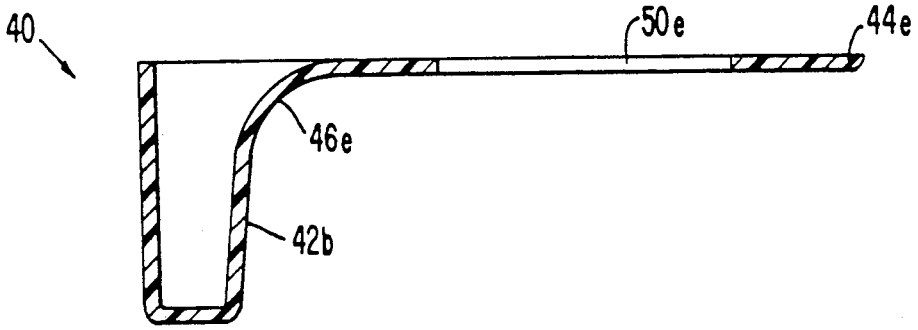
FIG. 4 is a sectional view taken generally along the lines 4—4 of FIG. 3.

As best seen in FIG. 2, plate members 44 extend horizontally from the medial side of sole member 12 toward the lateral side of sole member 12 and past the centerline L3 of heel section 20. As best seen in FIGS. 3 and 4, plate members 44*a* and 44*e* extend from rigid members 42*a* and 42*b* respectively and are connected to the rigid members through downwardly extending curved sections 46*a* and 46*e*. While plate members 44*b*, 44*c* and 44*d* are separate or independent plate members, they are interconnected along line x—x to common base 48 Common base 48 is integrally connected to side wall 45 of rigid member 42*a*, generally rectangular in shape and a center line y—y extending through the shorter sides of base 48 is substantially perpendicular to side wall 45 of rigid member 42*a*. To further reduce the weight and material costs of device 40, each plate member 44 has a centrally disposed gap 50.

Plate members 44*a* through 44*e* thus extend horizontally in a cantilever manner from the medial side of sole 12. That is, plate members 44*a* and 44*e* extend laterally from the top of rigid members 42*a* and 42*b*, respectively, and plate members 44*b*, 44*c* and 44*d* extend laterally from base 48 while center line z—z of plate member 44*c* is substantially perpendicular to interconnection x—x of base 48 with plate member 44*c*. Preferably, all plate members 44 extend along an area adjacent the top of midsole 16. Plate members 44 have a perimeter which tapers from a broadest area adjacent the medial side of sole 12 to a rounded point at their distal ends on the lateral side. Plate members 44 thus take on a finger or comb-like configuration. The tapering shape and cantilever extension of plate members 44 function to provide gradually increasing resistance to compression of sole member 12 disposed below the plate members. That is, along the distal ends of plate members 44, the plate members bend more easily and, hence, provide less resistance to compression. However, the portions of plate members 44 which are closer to their cantilever connection along the medial edge are more difficult to bend and provide increased resistance to compression. Maximum resistance to compression is reached along the medial edge of sole 12 where the rigid members 42*a* and 42*b* are located.

Figure 5:
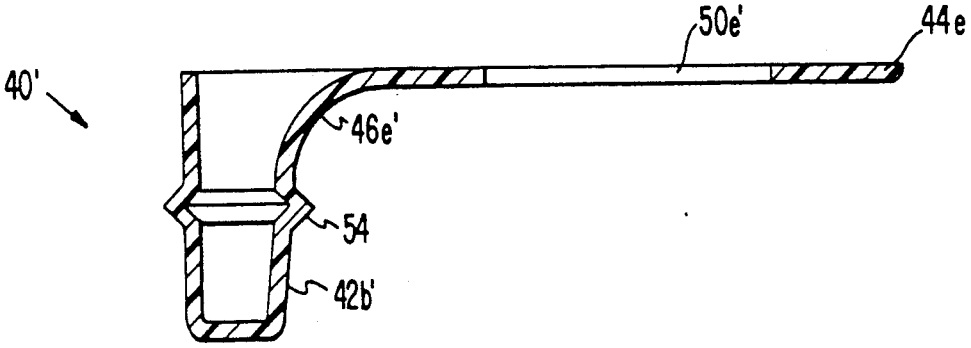
FIG. 5 is a sectional view similar to FIG. 4, illustrating an alternate embodiment of a pronation control device in accordance with the present invention.

FIG. 5 illustrates an alternate embodiment of a device 40' wherein rigid members 42 are again formed as hollow columns. However, the hollow columns include a spring or flex section 54 which allows the columns to compress vertically a limited degree. Spring section 54 is formed as a bent out section of the column which extends horizontally around the perimeter of the hollow column, thereby forming a bendable flex line. Device 40' is used when it is desirable to vary the compliance of the columns without relying on the use of foams or adjusting the modulus of the columns.

Numerous characteristics, advantages, and embodiments of the invention have been described in detail in the foregoing description with reference to the accompanying drawings. However, the disclosure is illustrative only and the invention is not limited to the precise illustrated embodiments. Various changes and modifications may be effected therein by one skilled in the art without departing from the scope and spirit of the invention. For example, while the plate members are illustrated as a plurality of separate finger like elements, the plate members can be formed as a single integral plate. Similarly, while two rigid members are illustrated, where appropriate a single rigid member, or more than two rigid members can be used.

We claim:

1. A cushioning sole for use in footwear comprising:

a sole member extending along at least a heel and an arch section of the cushioning sole, said sole member being compressible and resilient for cushioning foot impact;

a first substantially rigid member formed of substantially non-compressible material and incorporated into a medial half of said sole member;

a second substantially rigid member formed of substantially non-compressible material and incorporated into a medial half of said sole member, said first and second substantially rigid members spaced longitudinally from one another;

a common base formed of substantially non-compressible material, incorporated into said sole member and extending from said first and second substantially rigid members;

a first plate formed of substantially non-compressible material, incorporated into said sole member and integrally connected to and extending from said first substantially rigid member in a direction towards a lateral half of said sole member, said first plate having a proximate end portion integrally connected to said first substantially rigid member and having a distal end portion which extends past a center line of the heel section of said sole member, said first plate also having a gap, a portion of which is disposed on an opposite side of the heel section center line than said first substantially rigid member is disposed on; and a plurality of further plates depending from said common base towards a lateral half of said sole member, said plurality of plates aligned along said common base from the heel section and into the arch section of said sole member;

wherein said first substantially rigid member curves generally vertically away from said first plate in a direction towards a medial side wall of said sole member.

2. A cushioning sole as in claim 1, wherein said first plate extends past a center line of the heel section of said sole member into the lateral half of said sole member.

3. A cushioning sole for use in footwear comprising:

a sole member extending along at least a heel and an arch section of the cushioning sole, said sole member being compressible and resilient for cushioning foot impact;

a first substantially rigid member formed of substantially non-compressible material and incorporated into a medial half of said sole member;

a second substantially rigid member formed of substantially non-compressible material and incorporated into a medial half of said sole member, said two substantially rigid members spaced longitudinally from one another;

a common base formed of substantially non-compressible material, incorporated into said sole member, and integrally connected to and extending from said first and second substantially rigid members; and a first plate formed of substantially non-compressible material and incorporated into said sole member, said first plate having a proximate end portion integrally connected to said first substantially rigid member, said first plate extending toward a lateral half of said sole member, and said first plate having a distal end portion which extends past a center line of a heel section of said sole member into the lateral half of said sole member, said first plate also having a gap, a portion of which is disposed on an opposite side of the heel section center line than said first substantially rigid member is disposed on; and a plurality of further plates depending from said common base towards a lateral half of said sole member, said plurality of further plates aligned along said common base from the heel section and into the arch section of said sole member;

wherein the proximate end portion of said first plate extends no further towards a medial side wall of said sole member than a portion of said first substantially rigid member which is closest to said medial side wall.

4. A cushioning sole as in claim 3, wherein said first plate extends across more than two-thirds of the width of said heel section of said sole member.

5. A cushioning sole for use in footwear comprising:

a sole member extending along at least a heel and an arch section of the cushioning sole, said sole member being compressible and resilient for cushioning foot impact;

a first substantially rigid member incorporated into a medial half of said sole member, formed of substantially non-compressible material and including a portion extending generally vertically in said sole member;

a second substantially rigid member formed of substantially non-compressible material and incorporated into a medial half of said sole member, said first and second substantially rigid members spaced longitudinally from one another;

a common base formed of substantially non-compressible material, incorporated into said sole member, and integrally connected to and extending from said first and second substantially rigid members;

a plurality of plates incorporated into said sole member, formed of substantially non-compressible material, one of said plates integrally connected to said first substantially rigid member and extending in a cantilever manner from said first substantially rigid member;

wherein said first substantially rigid member and said one of said plurality of plates is disposed within substantially only the heel section of said sole member, and wherein the remainder of said plurality of plates depend from said common base towards a lateral half of said sole member, and are aligned along said common base from the heel section and into the arch section of said sole member.

6. A cushioning sole as in claim 5, wherein a portion of at least two of said plurality of plates are disposed on an opposite side of a center line of said heel section than said rigid member is disposed on.

7. A cushioning sole for use in footwear comprising:

an outsole;

a midsole connected to said outsole and having a heel, an arch and a forepart section;

a first substantially rigid member formed of substantially non-compressible material, incorporated into a medial half of said midsole, disposed rearward of said forepart section of said midsole, and extending generally vertically in said midsole, said first substantially rigid member including an outer side wall disposed adjacent a side wall of said midsole;

a second substantially rigid member formed of substantially non-compressible material and incorporated into a medial half of said midsole, said first and second substantially rigid members spaced longitudinally from one another;

a common base formed of substantially non-compressible material, incorporated into said midsole, and integrally connected to and extending from said first and second substantially rigid members;

a first plate formed of substantially non-compressible material, incorporated into said midsole, and disposed rearward of said forepart section of said midsole, said first plate having a proximate end portion integrally connected to said first substantially rigid member and having a distal end portion which extends past a center line of the heel section of said midsole, said first plate also having a gap, a portion of which is disposed on an opposite side of the heel section center line than said first substantially rigid member is disposed on, said proximate end portion of said first plate extending no closer to the side wall of said midsole which said first rigid member is adjacent to than said outer side wall of said first rigid member; and a plurality of further plates depending from said common base towards a lateral half of said sole member, said plurality of further plates aligned along said common base from the heel section and into the arch section of said sole.

8. A cushioning sole as in claim 7, wherein said proximate end portion of said first plate is more difficult to bend and provides increased resistance to compression of said midsole relative to said distal end portion of said first plate.

9. A cushioning sole as in claim 7, wherein said first plate is connected to said first rigid member through a substantially curved section.

10. A cushioning sole as in claim 7, wherein said first plate extends across more than two-thirds the width of said heel section of said midsole.

11. A cushioning sole as in claim 7, wherein said first rigid member and said first plate each have a flex modulus between 75,000 and 125,000 psi.

12. A cushioning sole for use in footwear comprising:

an outsole;

a midsole connected to said outsole and having a heel, an arch and a forepart section;

a first substantially rigid member formed of substantially non-compressible material, incorporated into a medial half of said midsole, disposed rearward of said forepart section of said midsole, and extending generally vertically in said midsole, said member including an outer side wall disposed adjacent a side wall of said midsole;

a second substantially rigid member formed of substantially non-compressible material and incorporated into a medial half of said midsole, said first and second substantially rigid members spaced longitudinally from one another;

a common base formed of substantially non-compressible material, incorporated into said midsole, and integrally connected to and extending from said first and second substantially rigid members;

a first plate formed of substantially non-compressible material, incorporated into said midsole, and disposed rearward of said forepart section of said midsole, said first plate having a proximate end portion integrally connected to said first substantially rigid member and having a distal end portion which extends past a center line of the heel section of said midsole, said first plate also having a gap, a portion of which is disposed on an opposite side of the heel section center line than said first substantially rigid member is disposed on; and a plurality of further plates depending from said common base towards a lateral half of said sole, said plurality of further plates aligned along said common base from the heel section and into the arch section of said sole.

13. A cushioning sole as in claim 12, wherein said proximate end portion of said first plate extends no closer to the side wall of said midsole which said first rigid member is adjacent to than said outer side wall of said first rigid member.

14. A cushioning sole for use in footwear comprising:

a sole member having a heel, an arch and a forepart section;

a first substantially rigid member formed of substantially non-compressible material, incorporated into a medial half of said sole member, disposed rearward of said forepart section of said sole member, and extending generally vertically in said sole member, said first substantially rigid member including an outer side wall disposed adjacent a side wall of said sole member;

a second substantially rigid member formed of substantially non-compressible material and incorporated into a medial half of said sole member, said first and second substantially rigid members spaced longitudinally from one another;

a common base formed of substantially non-compressible material, incorporated into said sole member, and integrally connected to and extending from said first and second substantially rigid members;

a first plate formed of substantially non-compressible material, incorporated into said sole member, disposed rearward of said forepart section of said sole member, integrally connected to said first substantially rigid member and extending from said first substantially rigid member in a direction towards an opposite half of said sole member than the half of said sole member in which said first rigid member is disposed, said first plate having a gap, a portion of which is disposed on said opposite half of said sole member;

a plurality of further plates depending from said common base towards a lateral half of said sole member, said plurality of plates aligned along said common base from the heel section and into the arch section of said sole member;

wherein said sole member includes an air filled chamber disposed directly below a portion of said first plate.

15. A cushioning sole as in claim 14, wherein said first plate is disposed on both sides of a center line of the heel section of said sole member.

16. A cushioning sole as in claim 14, wherein said first rigid member and said first plate each have a flex modulus between 75,000 and 125,000 psi.

17. A cushioning sole as in claim 14, wherein said first plate is connected to said first rigid member through a substantially curved section.

18. A cushioning sole as in claim 14, wherein said first plate extends across more than two-thirds the width of said heel section of said sole member.

19. A cushioning sole for use in footwear comprising:

an outsole;

a midsole connected to said outsole and having a heel, an arch and a forepart section;

a first substantially rigid member formed of substantially non-compressible material, incorporated into a medial half of said midsole, disposed rearward of said forepart section of said midsole and extending generally vertically in said midsole, said member including a first outer side wall disposed adjacent a side wall of said midsole and a second side wall;

a second substantially rigid member formed of substantially non-compressible material and incorporated into a medial half of said midsole, said first and second substantially rigid members spaced longitudinally from one another;

a common base formed of substantially non-compressible material, incorporated into said midsole, and integrally connected to and extending from said first and second substantially rigid members, said common base extending from said second side wall of said first rigid member; and a plurality of plates formed of substantially non-compressible material, incorporated into said midsole, integrally connected to and extending in a cantilever manner from said common base and having center lines extending perpendicular to a line where said plates are connected to said base, and wherein said center lines are substantially parallel to said second side wall of said first rigid member, said plurality of plates depending from said common base towards a lateral half of said midsole, said plurality of plates aligned along said common base from the heel section and into the arch section of said midsole;

said substantially rigid member, said common base and said plurality of plates disposed within said midsole rearward of the forepart section of said midsole.

20. A cushioning sole as in claim 19, wherein said second side wall of said first substantially rigid member is directly adjacent said first outer side wall of said substantially rigid member.

21. A cushioning sole as in claim 19, wherein said common base is generally rectangular in shape and a center line extending through shorter sides of said base is substantially perpendicular to said second side wall of said first rigid member.

22. A cushioning sole as in claim 19, wherein said first rigid member, said common base and said plates each have a flex modulus between 75,000 and 125,000 psi.

23. A cushioning sole as in claim 19, wherein said plurality of plates are disposed on both sides of a center line of the heel section of said midsole.

24. A cushioning sole as in claim 19, wherein a proximate end portion of said plates are connected to said common base and a distal end of said plate is rounded.

25. A cushioning sole as in claim 19, wherein said common base is encapsulated within said midsole.

26. A cushioning sole as in claim 25, wherein an area directly below said plates are filled with air.

* * * * *